United States Patent [19]

Newman et al.

[11] Patent Number: 4,919,190

[45] Date of Patent: Apr. 24, 1990

[54] RADIOACTIVE WASTE MATERIAL MELTER APPARATUS

[75] Inventors: Darrell F. Newman; Wayne A. Ross, both of Richland, Wash.

[73] Assignee: Battelle Memorial Institute, Richland, Wash.

[21] Appl. No.: 234,253

[22] Filed: Aug. 18, 1988

[51] Int. Cl.[5] ..... B22D 27/02

[52] U.S. Cl. ..... 164/250.1; 164/48; 164/495; 164/514; 373/22; 376/272; 252/633

[58] Field of Search ..... 252/633, 632, 628, 626; 376/272, 261, 260; 164/48, 250.1, 492, 493, 494, 495, 512, 513, 514; 373/22

[56] References Cited

U.S. PATENT DOCUMENTS

| | | | |
|---|---|---|---|
| 4,341,915 | 7/1982 | Adachi et al. | 252/632 |
| 4,432,942 | 2/1984 | Adachi et al. | 252/626 |
| 4,641,704 | 2/1987 | Lowe | 164/494 |
| 4,668,153 | 5/1987 | Sperinck et al. | 376/272 |

OTHER PUBLICATIONS

Moriyama et al., "Volume Reduction of Non-Combustible Radioactive Solid Wastes By Plasma Melting", Waste Management 86.

Westnik, Jr. et al., "Induction Melting For Volume Reduction of Metallic Tru Wastes", Waste Management 86.

Ross et al., "Treatment Alternatives for Non-Fuel--Bearing hardware", PNL-6098, 1/87.

Ross et al., "Evaluation of Alternative Treatments for Spent Fuel Rod Consolidation Wastes and Other Miscellaneous Commercial Tranuranic Wastes", PNL-5838, 5/86.

Luksic et al., "Spent Fuel Disassembly Hardware and Other Non-Fuel Bearing Components: Characterization, Disposal Cost Estimates, and Proposed Repository Acceptance Requirements", PNL-6046, 10/86.

McKee et al., "Waste Management System Alternatives for Treatment of Wastes from Spent Fuel Reprocessing", PNL-6005, 9/86.

*Primary Examiner*—Daniel Wasil

*Attorney, Agent, or Firm*—Wells, St. John & Roberts

[57] ABSTRACT

An apparatus for preparing metallic radioactive waste material for storage is disclosed. The radioactive waste material is placed in a radiation shielded enclosure. The waste material is then melted with a plasma torch and cast into a plurality of successive horizontal layers in a mold to form a radioactive ingot in the shape of a spent nuclear fuel rod storage canister. The apparatus comprises a radiation shielded enclosure having an opening adapted for receiving a conventional transfer cask within which radioactive waste material is transferred to the apparatus. A plasma torch is mounted within the enclosure. A mold is also received within the enclosure for receiving the melted waste material and cooling it to form an ingot. The enclosure is preferably constructed in at least two parts to enable easy transport of the apparatus from one nuclear site to another.

8 Claims, 7 Drawing Sheets

24
26
10
11
12
33
18
42
30
40'
44
42
38
36
34
40
28
43
41
74
16
32
45
20
22
50
54
14

10
60

5
62
12
30
22
20
30
64
24
46
46
74
46
46
16
50
14
46
44
46
18
22
20
5

RADIOACTIVE WASTE MATERIAL MELTER APPARATUS

This invention was made with government support under Contract No. DE-AC06-76RLO 1830 awarded by the U.S. Department of Energy. The government has certain rights in the invention.

TECHNICAL FIELD

This invention relates to treatment of radioactive waste material for storage. More particularly, the invention relates to treatment of the non-fuel bearing hardware of spent nuclear fuel assemblies of boiling water and pressurized water nuclear reactors.

BACKGROUND OF THE INVENTION

Nuclear fuel assemblies used by nuclear power plants typically have a life span of about 3 years. Once the fuel of the assembly has been exhausted, the assembly must be removed from the reactor that powers the nuclear plant. Although no longer useful for generating power, the fuel assembly is still highly radioactive and must be stored for hundreds or even thousands of years before the material is no longer a threat to the environment.

Spent fuel assemblies are presently being stored in large pools or water basins at nuclear reactor sites. One of the primary methods of expanding existing storage capacity of water basins at nuclear reactor sites is spent fuel rod consolidation. A fuel assembly includes a series of long metal clad fuel rods typically comprised of uranium oxide. The fuel rods are held in the required geometry to be usable within a nuclear reactor by metal hardware spaced between and along the length of the rods of a given assembly. Fuel rod consolidation is a process that involves dismantling the fuel assembly and rearranging the spent fuel rods into an even closer-packed geometry within a storage canister. Typically, all of the fuel rods from two spent fuel assemblies can be loaded into a single storage canister that has the same overall external dimensions of a spent fuel assembly prior to its dismantlement. Such an assembly can be safely stored in the water basins at nuclear reactor sites. Except for the metal hardware left over from the rod consolidation operation, the method has the potential to double existing storage capacity at reactor sites that have pools with sufficient structural strength to safely support the added weight. Rod consolidation is relatively low-cost alternative to providing additional storage pools.

The non-fuel hardware left over from rod consolidation includes end fittings, rod spacer grids, and control rod guide thimbles for pressurized water reactor spent fuel. For boiling water reactor spent fuel, the hardware includes tie plates, rod spacer grids and flow channels. The radioactive isotopes of most concern for storage and handling which are most commonly formed in the hardware by radiation in the reactor are cobalt-60, niobium-94 and nickel-59. The degree of radioactivity of the waste hardware is typically much less than the degree of radioactivity of the spent fuel on a unit volume basis. However, because of the penetrating power of cobalt-60 gamma radiation, it requires comparable radiation shielding. The lower amount of radioactivity means that less heat is generated by the spent fuel hardware and that a greater amount of non-fuel hardware could be stored safely in a given volume than that for spent fuel.

The current method used for volume reduction of non-fuel hardware has been low pressure compaction with hydraulic presses. This method can typically reduce the volume of the hardware from six pressurized water reactor fuel assemblies to the volume inside a single canister the same external dimensions of a typical spent fuel assembly containing consolidated fuel rods. Similarly, the hardware from five boiling water reactor fuel assemblies can be compacted into the volume of a single canister of the same size as a typical spent fuel assembly. The larger hardware volume associated with boiling water reactor fuel assemblies is due to an additional hardware component not present in pressurized water reactors. Collectively, the present overall achievable storage capacity volume reduction factor for fuel and hardware is about 1.4. In other words, 1.4 spent nuclear fuel assemblies including the associated hardware can be consolidated and stored in the same volume as one fuel assembly in the configuration it is received within the nuclear reactor.

Alternate methods have also been evaluated for processing non-fuel hardware to increase its density and correspondingly reduce its storage volume requirements. Two methods under consideration are shredding/super-compaction and melting. Shredding would be a one-step process that allows metal pieces to fit inside canisters and increases their bulk density. Super-compaction provides greater volume reduction of shredded non-fuel hardware without extensive treatment. It is similar to low pressure compaction except that it uses pressures of about 60 MPa (as opposed to about 7 MPa presently used) that increases the final bulk density to about 50% to 80% of theoretical maximum. Present low pressure compaction achieves about 25% of theoretical maximum density. Shredding and super-compaction are discussed in Ross et al., "Treatment Alternatives for Non-Fuel-Bearing Hardware", January, 1987, and is incorporated herein by reference.

The melting alternative provides the highest possible volume reduction of waste radioactive material to a bulk density near theoretical maximum. At this density, the non-fuel hardware will occupy only about 2%–5% of its volume in the original spent fuel assemblies. In other words, a twenty to forty-fold reduction of volume is theoretically possible. However, heating of the metals to very high temperatures under controlled and radiation-shielded conditions would be necessary. An article authored by Westsik et al., "Induction Melting for Volume Reduction of Metal Tru Wastes", 1986, identifies induction melting as the preferred process for volume reduction of radioactive metal waste material. The article discloses induction melting of waste material into a graphite crucible inside of a large vacuum chamber. However, high stainless steel content of the melt is corrosive to graphite crucibles. The Ross et al. article identified above also discusses melting as a possible alternative for consolidation and compacting of non-fuel hardware at pages 6.4–6.6.

Page A.9 of Ross et al., *Evaluation of Alternative Treatments for Spent Fuel Rod Consolidation Wastes and Other Miscellaneous Commercial Transuranic Wastes,* 1986, discloses the possibility of using a plasma arc in a melter system. The published paper Moriyama et al., *Volume Reduction of Non-Combustible Radioactive Solid Wastes by Plasma Melting* also discloses melting of waste with a plasma gun.

The present invention is an improvement over the above teachings. The invention arose primarily from the needs and concerns associated with consolidating non-fuel hardware of spent nuclear fuel assemblies. It will be appreciated by those skilled in the art that the concepts of the invention could be employed for consolidating many other radioactive waste materials for storage.

BRIEF DESCRIPTION OF THE DRAWINGS

Preferred embodiments of the invention are illustrated in the accompanying drawings, in which:

FIG. 1 is a top cross sectional view looking downwardly into a radioactive waste material melting apparatus in accordance with the invention.

FIG. 6 is an enlarged, partially exploded view of a crucible or mold portion of the apparatus of FIG. 1 illustrating a formed ingot.

DETAILED DESCRIPTION OF PREFERRED EMBODIMENTS

Figure 11:
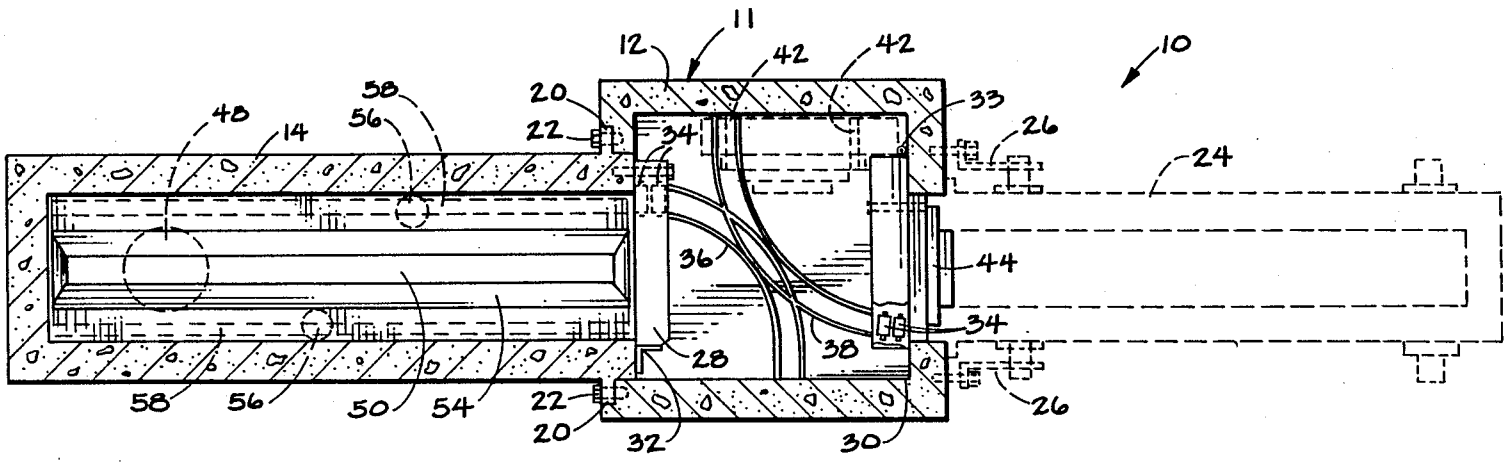

The following disclosure of the invention is submitted in compliance with the constitutional purpose of the Patent Laws "to promote the progress of science and useful arts" (Article 1, Section 8).

Referring to FIGS. 1-5, a radioactive waste material melting apparatus for melting metallic radioactive waste material for consolidation into a radioactive ingot for storage is indicated generally by reference numeral 10. Apparatus 10 comprises a radiation shielded enclosure 11 constructed in two sections 12, 14. Section 12 is termed as a mating cell, while section 14 is termed as a process chamber. Both are constructed of a suitable radiation shielding material, such as steel or concrete, and are of a sufficient thickness to prevent appreciable radiation leakage therethrough. Multi-piece construction facilitates portability of apparatus 10 and accordingly the ease of transport of the apparatus from one nuclear reactor site to another. Apparatus in accordance with the invention are preferably constructed to be portable to enable easy transfer from one nuclear plant to another, as will be more fully explained below.

Mating cell 12 is of a general square, box-like construction having opposed openings 16, 18 formed in two of its opposed sidewalls. Opening 16 defines a process chamber opening within which an end of process chamber 14 is matingly received. A projecting flange 20 is formed about the mating end of process chamber 14. Flange 20 is bolted to a sidewall of mating cell 12 by a series of bolts 22. In this manner, process chamber 14 is removably sealed or attached to mating cell 12 about mating cell process chamber opening 16. The process chamber 14 is square in lateral section and longitudinally elongated providing the rectangular longitudinal profile of FIGS. 1 and 2.

Transfer cask opening 18 is sized and shaped to join with a transfer cask 24 within which radioactive waste material is transferred to apparatus 10. Cask 24 removably bolts externally to mating cell 12 for sealing it about transfer cask opening 18 by means of a pair of bolt and retaining collar assemblies 26.

Mating cell 12 includes a pair of internal doors 28, 30 for opening and closing process chamber opening 16 and transfer cask opening 18 respectively, relative to the internal volume of mating cell 12. Each door is constructed of a radiation shielding material, such as steel or concrete, and is sufficiently thick to prevent appreciable escape of radiation from mating cell 12 when it is sealed about its respective opening 16 or 18. Both doors 28, 30 are supported at opposite ends by hinges. Hinges 32 are mounted to one end of process chamber 14 and support door 28. Hinges 33 are mounted to mating cell 12 and support door 30. Each door opens inwardly into the mating cell. The end of each door 28, 30 opposite the hinged end is supported by a pair of cylindrical roller wheels 34 mounted at the bottom s of the respective doors. Each pair of wheels 34 rotates or rides within an associated arcuate track 36 or 38 for opening and closing of doors 28, 30 respectively. Each door can be opened or closed when the other door is in either of its fully opened or fully closed positions. Hydraulic cylinders (not shown) can be provided inside of cell 12 to enable selective opening and closing of doors 28 and 30.

Door 28, which opens and closes relative to process chamber 14 and process chamber opening 16, includes a plurality of holes 41 (FIG. 3) having bolts 43 slidably received therethrough. The heads of bolts 43 bear against the opposite side of door 28 from process chamber opening 16 such that the threaded ends of bolts 43 project towards process chamber 14 when door 28 is closed. Bolts 43 thread into holes 45 formed in the end of process chamber 14.

Door 30, which opens and closes relative to transfer cask opening 18, includes a plurality of holes 40 (FIG. 3) having bolts 42 slidably received therethrough. The heads of bolts 42 bear against the opposite side of door 30 from transfer cask opening 18 such that the threaded ends of bolts 42 project in the direction of transfer cask opening 18 when door 30 is closed.

Transfer cask 24 is constructed of radiation shielding material, such as lead clad with stainless steel, suitable for loading into water basins at nuclear reactor sites. It includes an end lid 44 which is bolted to the end which adjoins with mating cell transfer cask opening 18. Lid 44 includes a series of eight holes 46 which receive bolts for securing lid 44 relative to cask 24. Holes 40 in door 30 align with at least two of holes 46 in transfer cask lid 44. To remove transfer cask lid 44 from transfer cask 24, door 30 would be swung open and the bolts which secure transfer cask lid 44 to transfer cask 24 would be removed. Door 30 would then be swung closed to be positioned over transfer cask opening 18. Bolts 42 would then be threaded into the aligned pair of holes 46 to join lid 44 with door 30. Door 30 would then be swung open which effectively removes lid 44 from transfer cask 44 enabling access to its contents. Lid 44 would be replaced in reverse fashion, when desired.

A plasma torch 48 (FIG. 2) is mounted within enclosure 11 for melting the radioactive waste material obtained from transfer cask 24. A mold 50 is also received within enclosure 11 for receiving the melted hardware and cooling it to form an ingot. More particularly, plasma torch 48 is movably mounted along a central rail assembly 52 extending along the length of process chamber 14. Mold 50 is elongated, and rests on the bottom of process chamber 14 and extends longitudinally and horizontally therealong. It is positioned directly beneath plasma torch 48. Plasma torch 48 is mounted for back and forth horizontal movement within process chamber 14 directly above mold 50 along rails 52.

Mold 50 is rectangular in lateral cross section having an internal shape corresponding to the external shape of a spent consolidated fuel assembly storage canister. Mold 50 could also of course be of an alternate shape to provide an alternate shaped ingot. The same shape as a spent nuclear fuel consolidation canister is preferred to optimize transport and storage geometries for waste material from nuclear power plants. Mold 50 includes outwardly flaring upper edges 54 to assist in guiding material into mold 50. Mold 50 is preferably made of copper and is fluid cooled by fluid flowing through a series of coolant pipes formed therein, as will be described below.

Two manipulators 56 (FIG. 2) are independently mounted to the roof of process chamber 14 on rails 58 extending parallel with process torch rails 52 and on opposite sides thereof. Manipulators 56 enable selective positioning of the various waste material to be melted within mold 50, and assist in removing a finished or formed ingot from process chamber 14, as will be more fully described below.

Another manipulator 60 (FIG. 2) will typically be mounted at the top of mating cell 12 for transferring material from transfer cask 24 to process chamber 14. Manipulator 60 includes a telescoping arm assembly 64 having movable jaws 72 mounted at the outer end thereof. A threaded opening 62 is provided in the top of mating cell 12 through which telescoping arm assembly 64 of manipulator 60 extends. Manipulator 60 is bolted to the top of mating cell 12 by bolts 66 which extend through a mounting flange 70 on apparatus 60. Bolts 66 thread into holes or inserts provided in mating cell 12.

Figure 2:
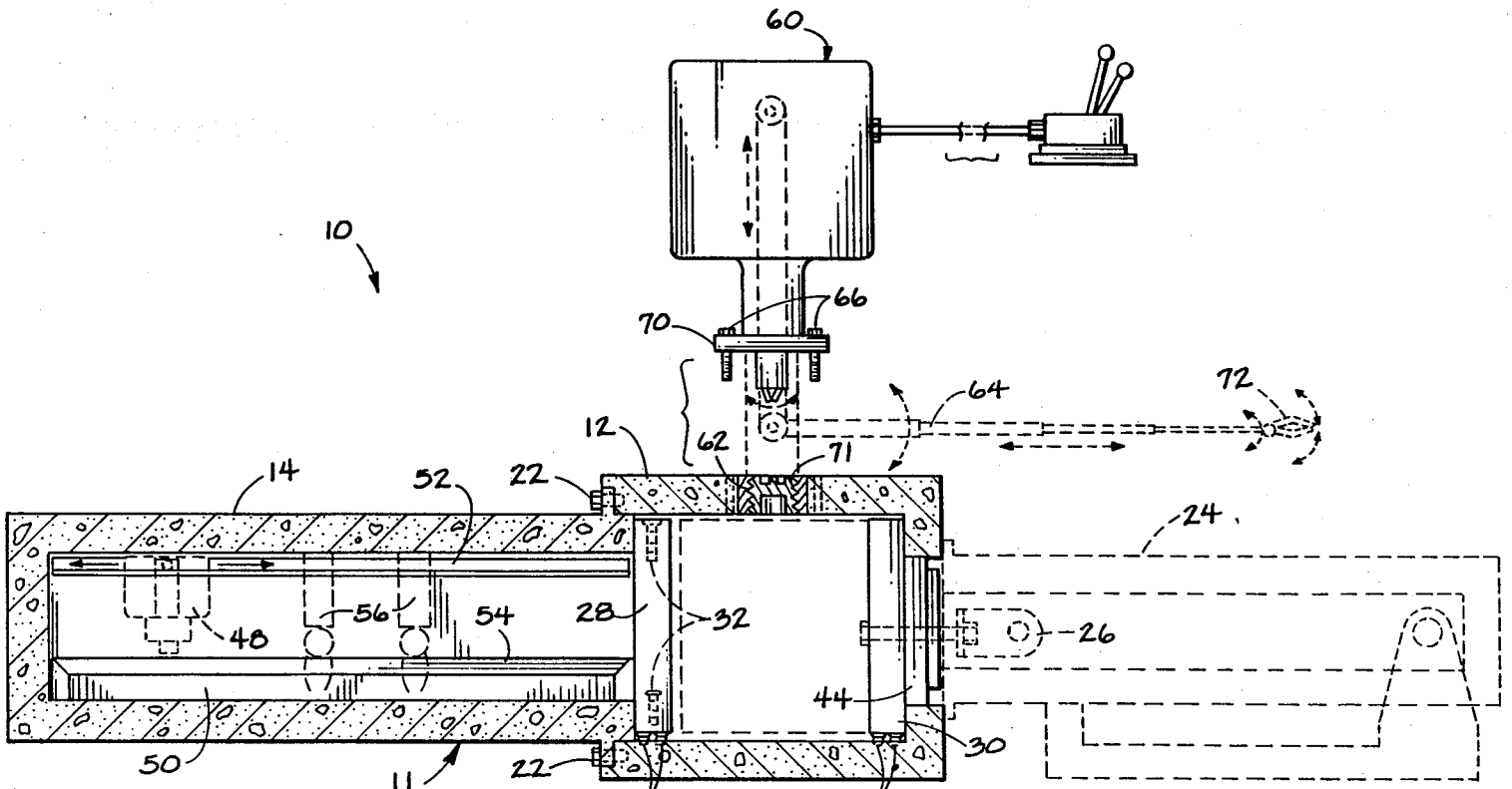
FIG. 2 is a partially exploded, side cross-sectional view of FIG. 1.

A threaded plug 71 is provided for threading into opening 62 for sealing mating cell 12 relative to the environment when manipulator 60 is removed from the cell. FIG. 2 illustrates plug 71 sealingly in place in threaded opening 62. Telescoping arm assembly 74 is entirely retractable to within manipulator 60. To access mating cell 12, manipulator 60 would first be bolted to the top of mating cell 12 about opening 62. Jaws 72 at the end of telescoping arm assembly 64 would then engage the top of plug 71 to rotate and thread it out of opening 62 and into the internal mating cell volume. Plug 71 would be placed out of the way within mating cell 12 until manipulator 60 would be removed from the mating cell for repair or transport. At this point, plug 70 would be rethreaded within opening 62 before removing manipulator 60.

Manipulators 60 and 56 comprise manipulation means for, (a) transferring radioactive waste material into enclosure 11 from transfer cask 24 through transfer cask opening 18, and (b) transferring the radioactive ingot which is formed in mold 50 and out of enclosure 11. The manipulators enable operators to safely access the various radioactive contents of enclosure 11 and transfer cask 24.

Enclosure 11 would preferably be constructed to be airtight to enable air evacuation or pressurizing with an inert atmosphere to prevent oxidation of certain metals. Some form of a conventional exhaust system (not shown) would also preferably be employed to vent any volatile gases and gases used by the plasma torch during melting.

A method for using the apparatus to melt the waste material into an ingot could proceed as follows. Process chamber 14 would be bolted to mating cell 12 about process chamber opening 16. Transfer cask 24 would be bolted to mating cell 12 about transfer cask cell opening 18. Transfer cask opening cell door 30 would be swung open and manipulator 60 employed to remove the bolts securing transfer cask lid 44 to the transfer cask body. With the bolts removed and laid out-of-the-way within mating cell 12, transfer cask door 30 would then be swung shut. Bolts 42 would then be threaded to transfer cask lid 44 with manipulator 60. Transfer cask door 30 would then be swung open which would remove transfer cask lid 44 from transfer cask 24 in the process. Process chamber door 28 would then be swung open.

Figure 3:
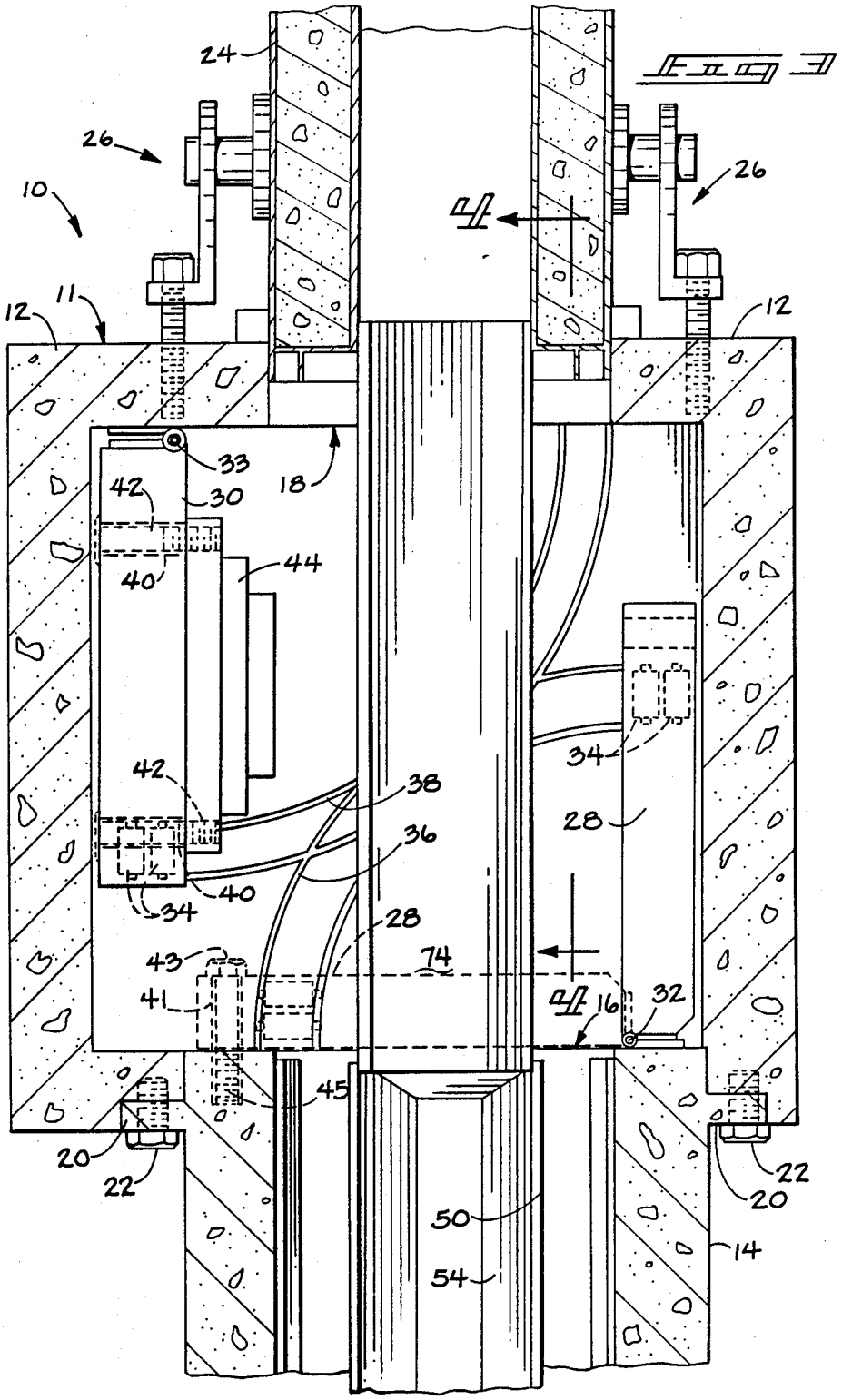
FIG. 3 is an enlarged top, cross-sectional view of a portion of the apparatus of FIG. 1.
Figure 4:
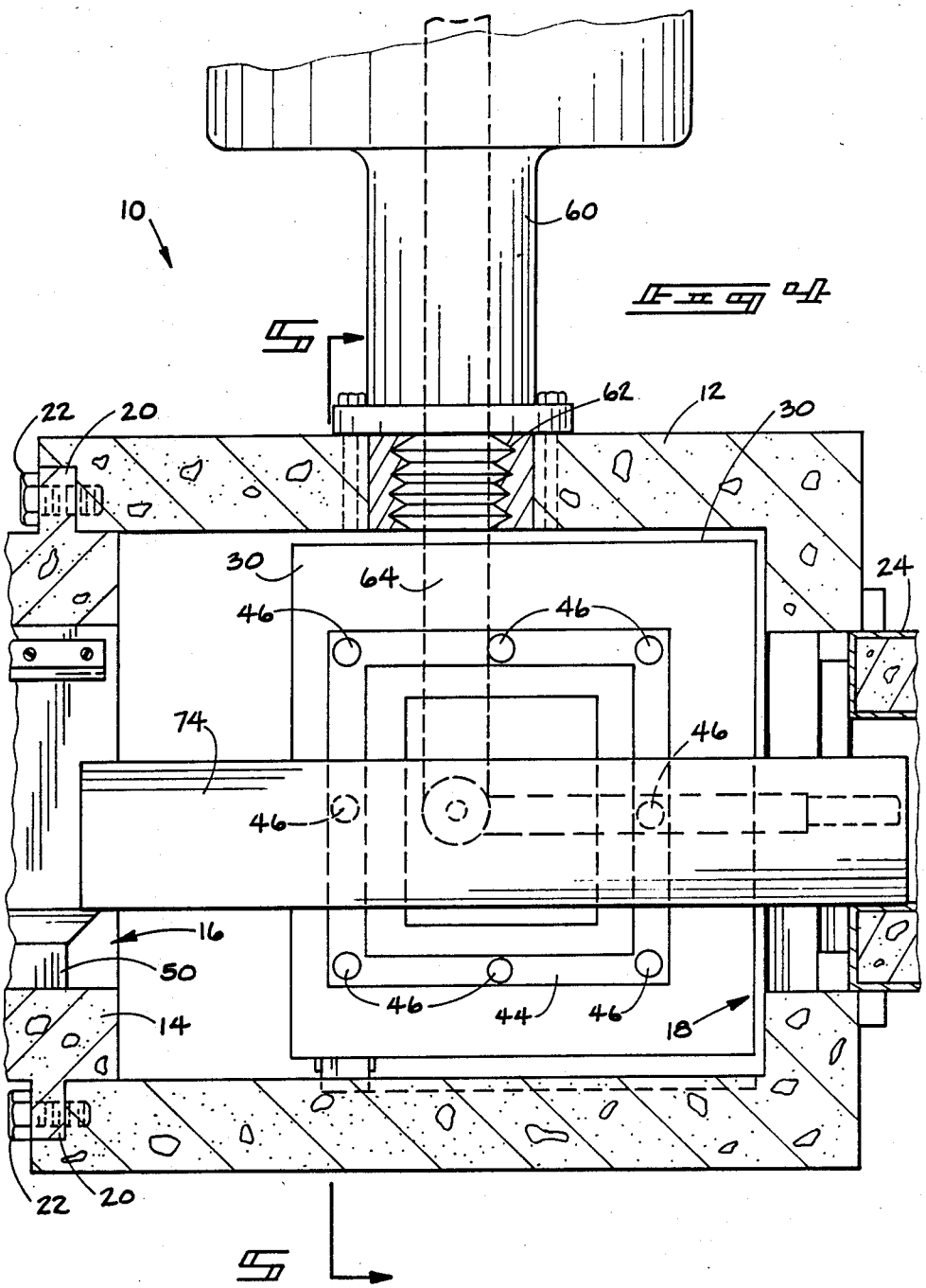
FIG. 4 is a cross-sectional view taken along line 4—4 in FIG. 3.
Figure 5:
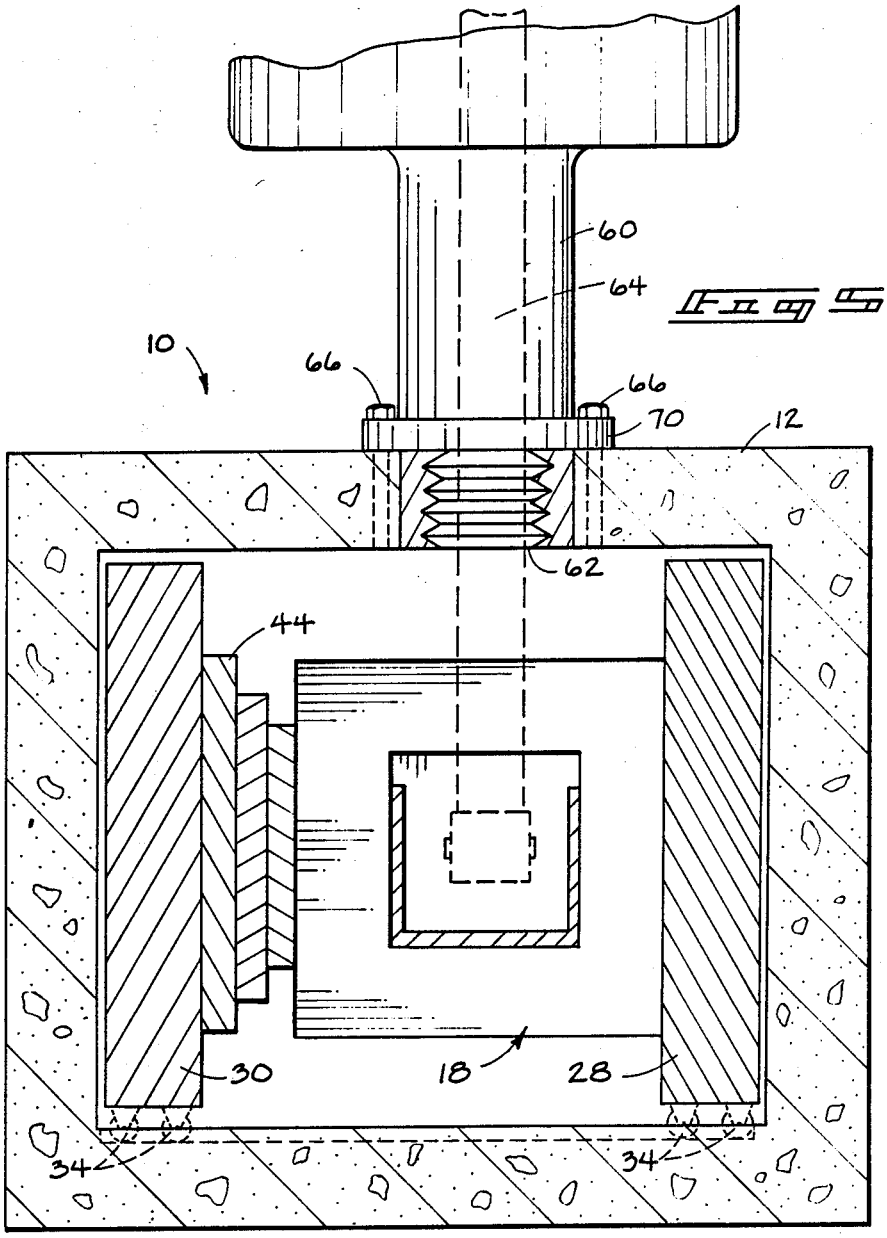
FIG. 5 is a cross-sectional view taken along line 5—5 in FIG. 4.
Figure 11:
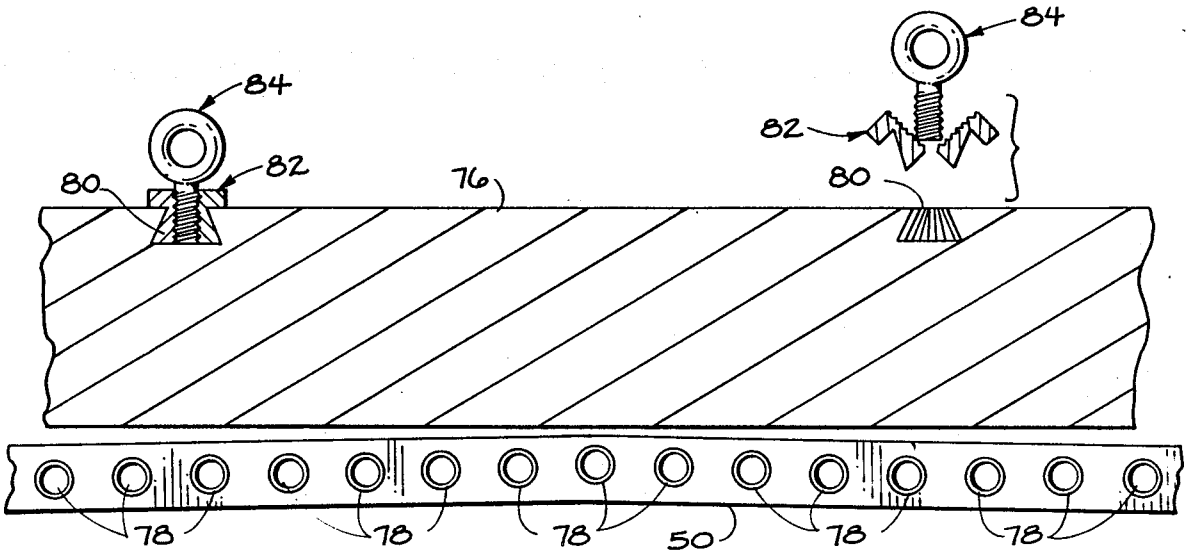

A guide channel 74 is provided to extend across mating cell 12 from mating cell opening 18 to process chamber opening 16, as illustrated in FIGS. 3 and 4. When not in use, guide channel 74 would typically be merely placed within process chamber 14. At this point in the method, with cell doors 28, 30 in their open positions, manipulator 60 would grasp guide channel 74 from within process chamber 14 and position it as shown in FIGS. 3 and 4.

Hardware waste material would then be transferred from transfer cask 24 through mating cell 12 within guide channel 74 and into process chamber 14 using manipulator 60. The hardware would be spread along the length of mold 50 with manipulators 56 and 60. Door 28 to process chamber 14 is preferably closed except when material is being transferred into or out of chamber 14. This will minimize any smearable contamination inside mating cell 12 and transfer cask 24.

Plasma torch 48 is then activated and moved horizontally back and forth along its rails 52 to melt the waste hardware material that has just been placed within mold 50. The hardware will melt and form an alloy of its constituent metals. The fluid-cooled copper mold 50 collects the melt and serves as a mold to shape the hardware into a spent fuel assembly shape as its solidifies. In this manner, melted radioactive material is cast into a mold to form a radioactive ingot.

When the material is completely melted into the bottom of the mold, plasma torch 48 is disengaged and manipulator 60 employed to bring more waste material from transfer cask 24 into and along mold 50. Plasma torch 48 is again then reactivated and moved along its rails to melt the newly placed material into the mold. In this manner, the material is melted into a plurality of successive horizontal layers within the mold to form or gradually raise the ingot. Each successive layer welds or otherwise metal bonds to the previous layer. The copper mold is fluid cooled during the melting process to prevent the mold itself from being melted by the plasma torch or melted metal.

FIG. 6 is a partial enlarged cross-sectional view illustrating a formed ingot 76 atop the floor of copper mold 50. As illustrated, mold 50 includes a series of cooling pipes 78 extending through its floor (and also its sidewalls) through which cooling fluid flows to keep mold 50 from melting. Also as illustrated in FIG. 6, the bottom surface of mold 50 is preferably upwardly convex. When ingot 76 is being formed in a plurality of horizontal layers, there is a tendency for the outer ends of the ingot to pull away from the mold which would produce a curved or bowed bottom surface. Curving of the bottom mold surface as illustrated would counter the ingot curvature and produce a flat bottom surface on the ingot. It is anticipated a horizontal mold fifteen feet long would have its outer ends downwardly displaced from its center approximately two inches or less to provide the desired convex shape.

Once ingot 76 is completely formed, a pair of inverted conical holes 80 are cut into the upper surface of ingot 76. Holes 80 are adapted to receive collapsible threaded inserts 82 therein. Eye bolts 84 thread to inserts 82. The trapezoidal nature of holes 80 (inverted conical) provides an interlock that prevents displacement of inserts 82 and correspondingly bolts 84 from the ingot. Manipulators 56 and 60 are then employed for lifting ingot 76 from mold 50 and transferring it out of enclosure 11 and into transfer cask 24 for transferring to a water basin for storage. It is anticipated that it will take several transfer cask loads of non-fuel hardware or other waste material to completely form ingot 76.

Alternate means for enabling access and separation of ingot 76 from mold 50 could also of course be provided. For example, a handling pintle or bail shape could be provided in the mold for handling by manipulators 56 and 60. Alternately, a preformed pintle or bail could be placed in the melt.

Volume reduction of spent nuclear hardware in accordance with the invention permits the storage capacity of existing methods for combined fuel and hardware to be increased from a factor of 1.4 to a factor of 1.8, an increase greater than 25%.

Apparatus in accordance with the invention are preferably constructed to be portable and therefore easily moved between nuclear plants. Typically, the enclosure will be constructed in a plurality of removably interconnected components to facilitate portability and transport of the apparatus. There would be significant cost savings in consolidating the radioactive material at the reactor sites prior to transport for long term storage elsewhere. Preliminary estimates indicate a 60% savings in processing waste material at reactor sites with a portable inventive apparatus over processing with an inventive apparatus at a central melter facility.

Figure 7:
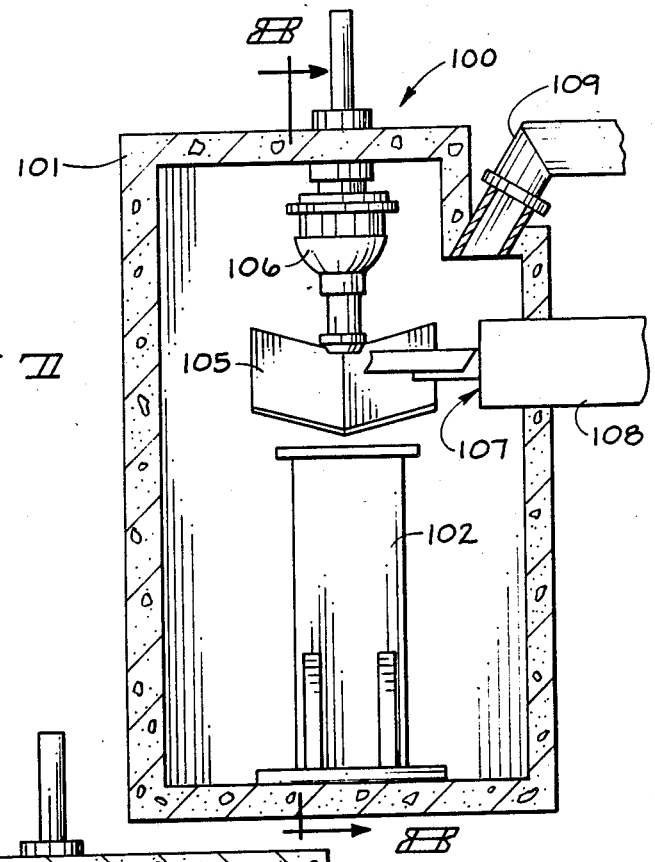
FIG. 7 is a side, cross-sectional view of an alternate embodiment radioactive waste material melting apparatus in accordance with the invention.
Figure 8:
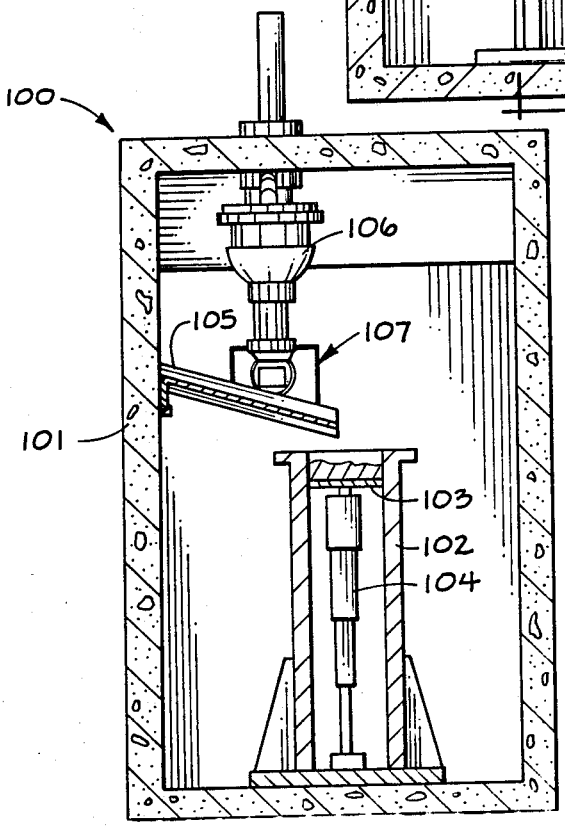
FIG. 8 is a cross-sectional view taken along line 8—8 in FIG. 7.

FIGS. 7 and 8 illustrate an alternate embodiment melting apparatus 100 in accordance with the invention. Apparatus 100 includes a radiation shielded enclosure 101 which is vertically elongated and substantially square in lateral cross section. A centrally displaced fluid-cooled copper mold 102 of desired cross section is vertically oriented along its length and extends upwardly from the base of enclosure 101. Mold 102 includes a starting plug or base 103 which can be lowered by a hydraulic ram 104.

An inclined hearth 105 is supported directly above mold 102. Hearth 105 is also preferably constructed of copper and is fluid cooled. A plasma torch 106 is stationarily mounted to the top of enclosure 101 directly above inclined hearth 105.

Enclosure 101 includes an opening 107 which is laterally aligned with the position of torch 106, and elevationally above hearth 105 but below the lower end of torch 106. Opening 107 is defined by the end of an intermediate cell 108 which extends into enclosure 101. Cell 108 would include manipulators (not shown) mounted thereto and be adapted for receiving a transfer cask at its opposite end (not shown). An off-gas or other ventilation access opening 109 is provided for exhausting volatiles generated in the process and for evacuating oxygen from the chamber where necessary to prevent reaction with certain metal being melted.

In operation, manipulators within cell 108 would feed hardware through opening 107 to plasma torch 106 where it would be melted onto hearth 105. The melted material would flow down hearth 105 and into crucible 102. As crucible 102 is filled, starting plug 103 is lowered with ram 104. The molten material within crucible 102 will shrink away from the crucible as it solidifies and somewhat cools. Ram 104 is lowered during the process until the desired length of ingot is formed.

In compliance with the statute, the invention has been described in language more or less specific as to structural and methodical features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A radioactive waste material melting apparatus for melting metallic radioactive waste material for consolidating such material into a radioactive ingot for storage, the apparatus comprising:

a radiation shielded enclosure, the enclosure comprising at least two separate sections which are removably interconnected, transportable, and reusable, one such section comprising a process chamber, another such section comprising a mating cell;

the process chamber being sized, shaped and dimensioned to facilitate transportability of the chamber and apparatus, the process chamber including a mating cell opening;

a reusable mold received within the process chamber, and being repeatably transportable therewith, for receiving and cooling melted radioactive material to form an ingot;

a plasma torch mounted within the process chamber, and being repeatably transportable therewith, for melting the radioactive waste material into the reusable mold;

the mating cell being sized, shaped and dimensioned to facilitate transportability of the cell and apparatus, the mating cell including a process chamber opening and a transfer cask opening;

the process chamber opening of the mating cell being sized and shaped to join with the mating cell opening of the process chamber, the process chamber being removably attached to the mating cell to place the same in communication with one another through their respective mating cell opening and process chamber opening;

the transfer cask opening being sized and shaped to join with a transfer cask within which radioactive waste material is transferred to the melting apparatus; and means for sealing the mating cell opening of the process chamber when the process chamber is removed from the mating cell for transport.

2. The melting apparatus of claim 1 further comprising:

manipulation means on the mating cell for, a) transferring radioactive waste material from a transfer cask through the transfer cask opening of the mating cell, through the mating cell, and into the process chamber, and b) transferring the formed radioactive ingot from the mold, through the mating cell, and out of the mating cell through the transfer cask opening.

3. The melting apparatus of claim 1 wherein the mold has an internal shape corresponding to the external size and shape of a spent nuclear fuel rod storage canister.

4. The melting apparatus of claim 1 further comprising:

a guide channel sized, shaped, and dimensioned to fit within the process chamber during transport, the guide channel in operation extending internally across the mating cell from a transfer cask opening to the process chamber opening for guiding the radioactive waste material from the transfer cask to the process chamber opening.

5. The melting apparatus of claim 1 wherein the mold is substantially horizontally positioned along its length within the process chamber, the mold including a bottom surface extending the length of the mold up from which the ingot is formed, the bottom surface being convex.

6. The melting apparatus of claim 1 further comprising a transfer cask sized and shaped to join with the mating cell transfer cask opening.

7. The melting apparatus of claim 6 wherein, the transfer cask includes a lid having a plurality of threaded holes formed therein, the melting apparatus further comprising means for opening and sealing the transfer cask opening of the mating cell;

the means for opening and sealing the transfer cask opening of the mating cell comprises a hinged door internally received within the mating cell, the hinged door having a plurality of holes formed therethrough which align with at least some of the plurality of the threaded holes formed in the transfer cask lid; and a plurality of bolts being received through the door holes, the bolts being sized to thread with the cask lid holes to enable the cask lid to be removably secured to the door for removing the cask lid from the transfer cask as the hinged door is swung.

8. The melting apparatus of claim 1 further wherein:

the shielded enclosure includes means for opening and sealing the transfer cask opening;

the mold is elongated having a length substantially greater than its width, and is substantially vertically oriented along its length within the enclosure;

a hearth is located within the enclosure adjacent a top portion of the mold;

the plasma torch is mounted above the hearth to melt radioactive waste material onto the hearth and to cause such melted material to flow into the mold; and the mold includes a vertically movable base supported by a hydraulic ram.

* * * * *